US006991262B1

(12) United States Patent
Ragner

(10) Patent No.: US 6,991,262 B1
(45) Date of Patent: Jan. 31, 2006

(54) PIVOTAL BODY FOR MULTI-FUNCTION NOZZLES

(76) Inventor: Gary Dean Ragner, 711 SW. 75th St. #103, Gainesville, FL (US) 32607

( * ) Notice: Subject to any disclaimer, the term of this patent is extended or adjusted under 35 U.S.C. 154(b) by 98 days.

(21) Appl. No.: 10/725,753

(22) Filed: Dec. 2, 2003

Related U.S. Application Data

(60) Provisional application No. 60/431,681, filed on Dec. 7, 2002.

(51) Int. Cl.
*A47L 9/02* (2006.01)

(52) U.S. Cl. ..... 285/7; 285/280; 15/417

(58) Field of Classification Search ..... 285/7, 285/184, 181, 278, 280; 15/400, 416, 417
See application file for complete search history.

(56) References Cited

U.S. PATENT DOCUMENTS 1,104,148 A 7/1914 Spencer
2,170,963 A * 8/1939 Dahl ..... 285/7
2,351,507 A * 6/1944 Hallock ..... 15/415.1
2,815,525 A * 12/1957 Lofgren ..... 15/417
2,960,716 A * 11/1960 Kemnitz ..... 15/417
3,108,311 A * 10/1963 House ..... 15/417
4,309,048 A * 1/1982 Ahlf et al. ..... 285/7
4,897,894 A * 2/1990 Fahlen ..... 15/365
5,079,796 A * 1/1992 Berfield et al. ..... 15/415.1
5,502,870 A * 4/1996 Ragner et al. ..... 15/393
6,581,974 B1 6/2003 Ragner

* cited by examiner

*Primary Examiner*—David Bochna

(57) ABSTRACT

The Pivotal Nozzle Body disclosed comprises an upper housing 50, and lower housing 30 which are pivotally connected to each other and can swivel with respect to each other about a pivot axis 40. Upper housing 50 and lower housing 30 have a first tool end 55 and a second tool end 34, respectfully. Both first and second tool ends are designed for mounting vacuum tools. Both first and second tool ends are designed to accept a hose wand for communicating suction air to the opposite side of the pivotal nozzle body. Whereby, both the vacuum tools may remain attached to the Pivotal Nozzle Body while hose wand 20 is alternated between the hose ports on the upper and lower housings.

20 Claims, 5 Drawing Sheets

PIVOTAL BODY FOR MULTI-FUNCTION NOZZLES

CROSS-REFERENCE TO RELATED APPLICATIONS

Figure 1:
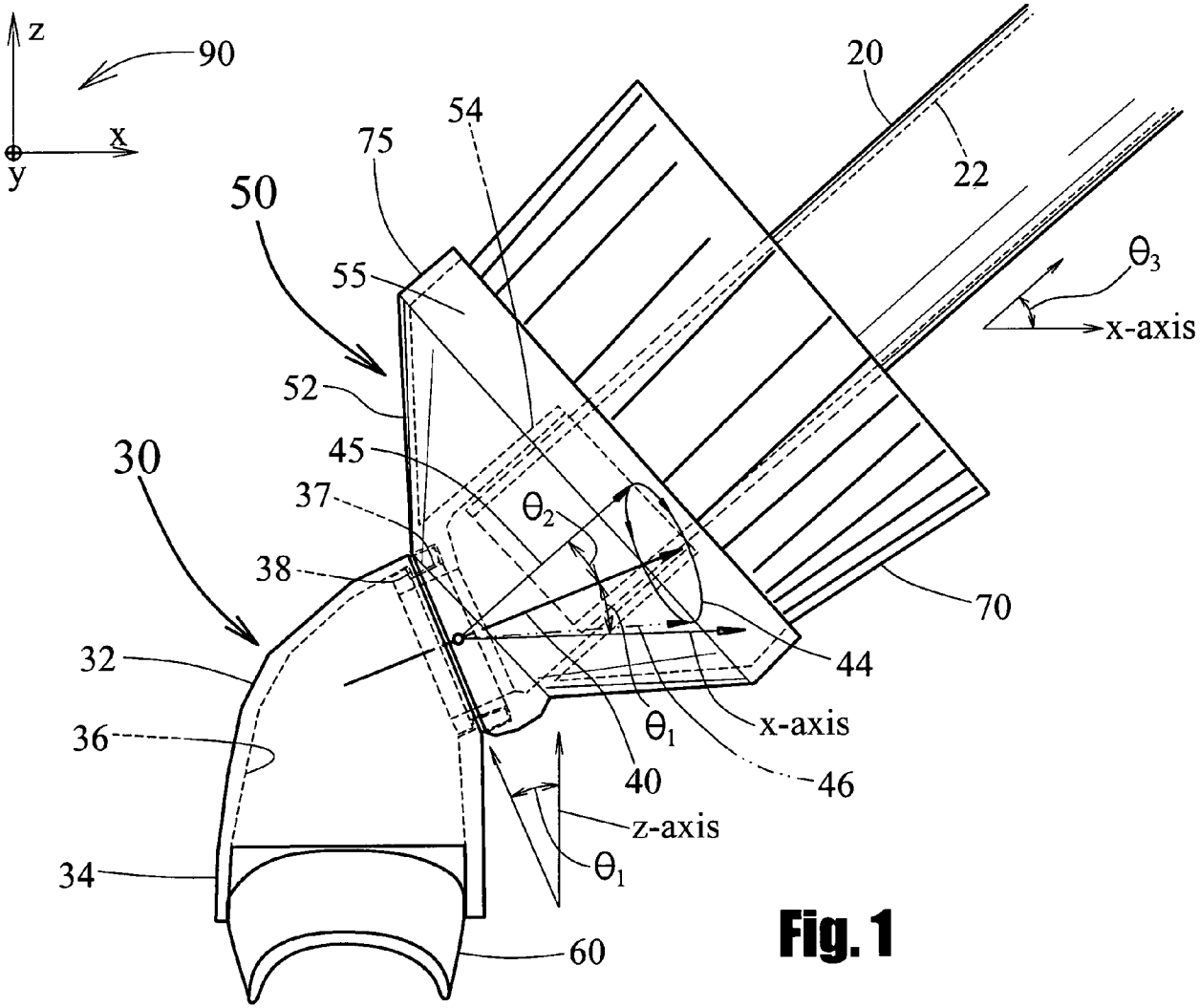

This utility application claims priority from U.S. Provisional application Ser. No. 60/431,681, titled "Pivot Nozzle Body" filed on Dec. 7, 2002, and U.S. Disclosure Document No. 483532, filed on Dec. 7, 2000.

BACKGROUND

1. Field of Invention

The field of this invention relates to cleaning nozzles for use with vacuum cleaner hoses, and more specifically to the nozzle body that holds the nozzle tools for use.

2. Description of Prior Art

Ever since the vacuum cleaner hose was invented, vacuum nozzle attachments have been around. Various types of vacuum tools of were invented to do specific cleaning functions. Soon it became apparent that for floor cleaning tools, and other vacuum tools, a pivot joint on the vacuum nozzle attachment made it more versatile. With a pivot joint one could rotated the nozzle to a specific angle for cleaning. For floor tools this allowed the vacuum tool to more easily follow the floor surface. This allowed the user to angle the hose wand to the floor to get under a low lying furniture while keeping the cleaning tool flush against the floor. For example, U.S. Pat. No. 1,104,148 to Spencer, and others like it, show a vacuum tool with a pivot joint to change the apparent angle between an inserted hose wand and the cleaning portion of the vacuum nozzle tool. No prior art was found which incorporated vacuum tool attachment points on both ends of the pivot joint. All prior art shows only one end of the pivot joint body being designed for attachment of vacuum nozzle tools. The presented invention provides vacuum nozzle attachment on both ends of the pivot joint. All prior art vacuum cleaner pivot adaptors provide one end for attachment of a vacuum cleaner hose wand, and the other end for attachment to a vacuum tool. For example, U.S. Pat. No. 6,581,974 to Ragner, and others like it, show a vacuum adaptor (or pivot body) with a pivot joint between its two ends: 1) a vacuum tool end, and 2) a vacuum hose wand end. No prior art was found that showed a vacuum pivot body with both ends being designed to accept both a vacuum tool and a vacuum hose wand at the same time and/or alternately. The ability to attach the hose wand to both ends of the pivot body is critical to the disclosed inventions application, as is, the ability to attach vacuum nozzles to both ends. Multi-function vacuum nozzles do exist, for example, U.S. Pat. No. 3,108,311 to House, and others like it, that are designed to provide both ends of the nozzle body with a hose wand port and a vacuum tool port. Also, additional ports have been demonstrated by the three port design shown in U.S. Pat. No. 5,502,870 to Ragner, where the nozzle body has two ports that accept a vacuum hose and two ports that have cleaning tools on them, with only one port that has both hose wand and vacuum tool attachment capabilities. None of these prior arts, however, suggest or show a pivot joint that would be beneficial for the operation of their device. The addition of a pivot joint on a two-ended multi-function vacuum tool, provides the desirable benefit of a pivot joint for both ends of the vacuum tool while only requiring a single pivot joint.

SUMMERY

When a vacuum nozzle is used for vacuuming a floor, the proper angle must be maintained with the contact surfaces to provide good cleaning contact with the floor. However, until now, multi-function nozzles with cleaning tools on both ends of the nozzle would have to maintain this contact angle by keeping the hose wand at a specific angle, usually about forty-five degrees with the floor. This severely restricts cleaning under low furniture where the fixed angle of the vacuum nozzle causes the nozzle's cleaning surface to lift off the floor when the attached hose wand is lowered to get under the furniture. Pivot joints are commonly placed on floor tools for this vary reason, however, multi-function tools that place tools on both ends have designed for use on floors, thus the use of a pivot joint to provide angle adjustment of the hose wand was not needed. It is only after the multi-function vacuum tool is designed for use on a floor, that one realizes the pivot joint is needed. The design of the pivot joint itself requires some additional thought to insure that both ends of the nozzle can function properly with the pivoting action between them. It turns out, in most cases that the pivot axis should be closer than 45 degrees from the x-axis as defined in FIGS. 1 through 7 by coordinate system 90. The multi-function nozzle can be made even more stable by keeping the pivot axis closer than 30 degrees from the x-axis. Where the x-axis is defined in a right-handed Cartesian coordinate system, with the longitudinal direction of the upholstery tool aligned with the y-axis, and the z-axis perpendicular to the floor surface being cleaned.

OBJECTIVES AND ADVANTAGES OF THE INVENTION

Nozzle Body a) To provide a pivotal nozzle body with an attachment means on both ends for connecting a vacuum cleaning tool(s).

b) To provide a pivotal nozzle body with an attachment means on both ends for connecting a vacuum cleaner hose wand.

c) To provide a pivotal nozzle body with an attachment means on both ends for alternately connecting a vacuum cleaning tool and vacuum cleaner hose wand.

d) To provide a pivotal nozzle body with an attachment means one end for connecting a vacuum cleaning tool and a vacuum cleaner hose wand at the same time.

e) To provide a pivotal nozzle body with two ends each designed for attachment of a vacuum cleaning tool and a vacuum cleaner hose wand at the same time.

Vacuum Nozzle f) To provide a pivot nozzle comprising a pivotal nozzle body with a replaceable cleaning tool(s) on two ends of the nozzle's pivotal nozzle body.

g) To provide a pivot nozzle comprising a pivotal nozzle body with an integrated cleaning tool on one end of the nozzle's pivotal nozzle body and an attachment means on a second end of the nozzle's pivotal nozzle body for removably connecting a vacuum cleaning tool(s).

h) To provide a pivot nozzle comprising a pivotal nozzle body with an integrated cleaning tool(s) on two ends of the nozzle's pivotal nozzle body.

i) To provide a pivot nozzle comprising a pivotal nozzle body with a replaceable cleaning tool(s) and a hose wand port on each of the two ends of the pivotal nozzle body.

j) To provide a pivot nozzle comprising a pivotal nozzle body with a replaceable cleaning tool(s) and a hose wand port on one end of the pivotal nozzle body, and an integrated cleaning tool(s) and a hose wand port on the other end of the pivotal nozzle body.

k) To provide a pivot nozzle comprising a pivotal nozzle body with an integrated cleaning tool(s), and a hose wand port on each of the two ends of the pivotal nozzle body.

Pivot Joint l) To provide a stable pivot joint for a two-ended multi-function vacuum tool when cleaning in different cleaning modes.

m) To provide a pivot joint with a built in friction that is sufficient for dusting mode, but small enough to allow easy pivoting when using in floor cleaning mode.

n) To provide a pivot joint with a pivot axis less than 30 degrees from the x-axis as defined in this patent.

o) To provide a pivot joint with a pivot axis less than 30 degrees from the x-axis as defined in this patent, and with the pivot axis having both y-axis, and z-axis components.

DRAWING FIGURES

FIG. 1 Pivotal nozzle body with pivotal arms on one end and a dust brush on the other.

Figure 2:
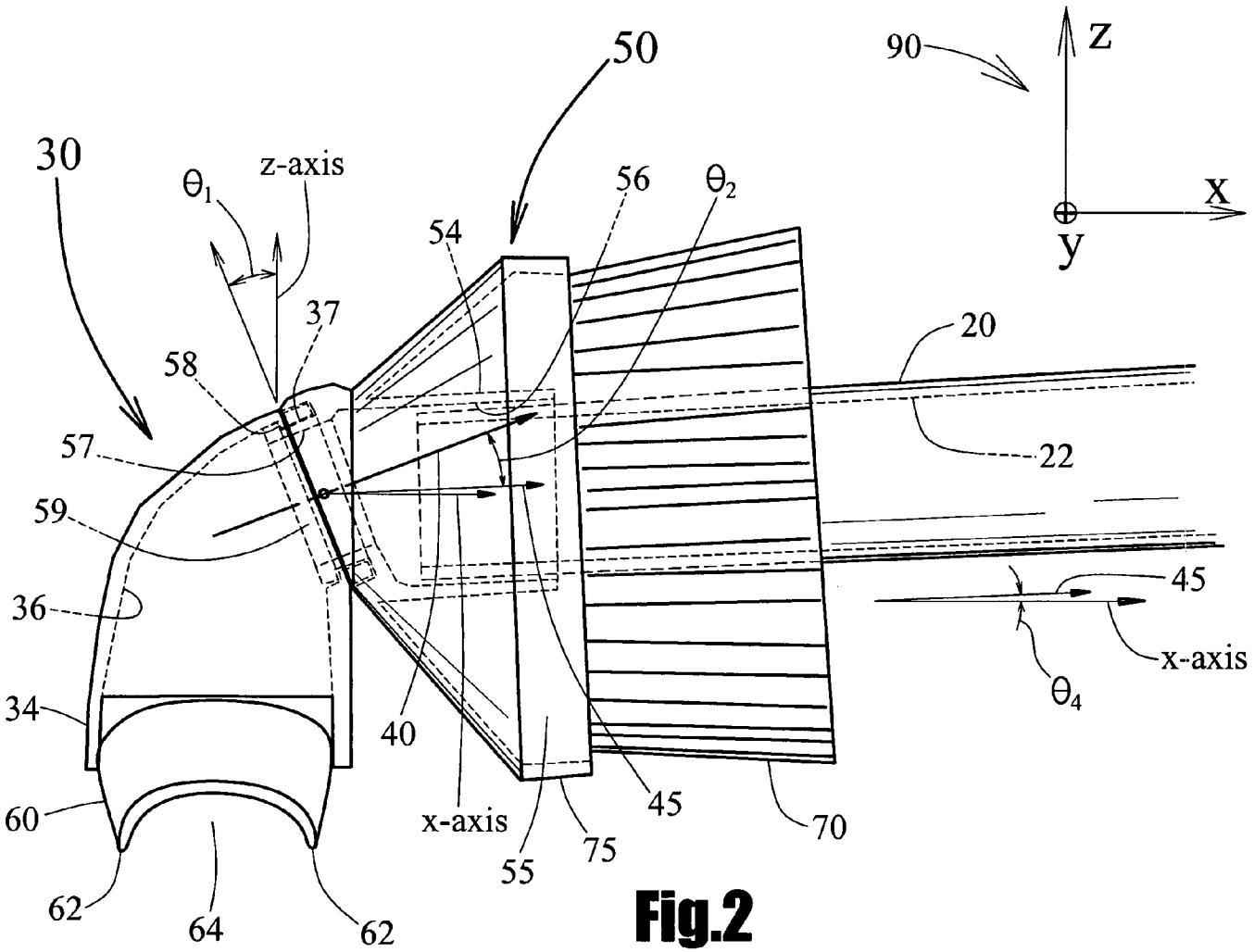

FIG. 2 Pivot Nozzle in FIG. 1 with upper housing rotated 180 degrees from its position in FIG. 1.

Figures 3, 4:
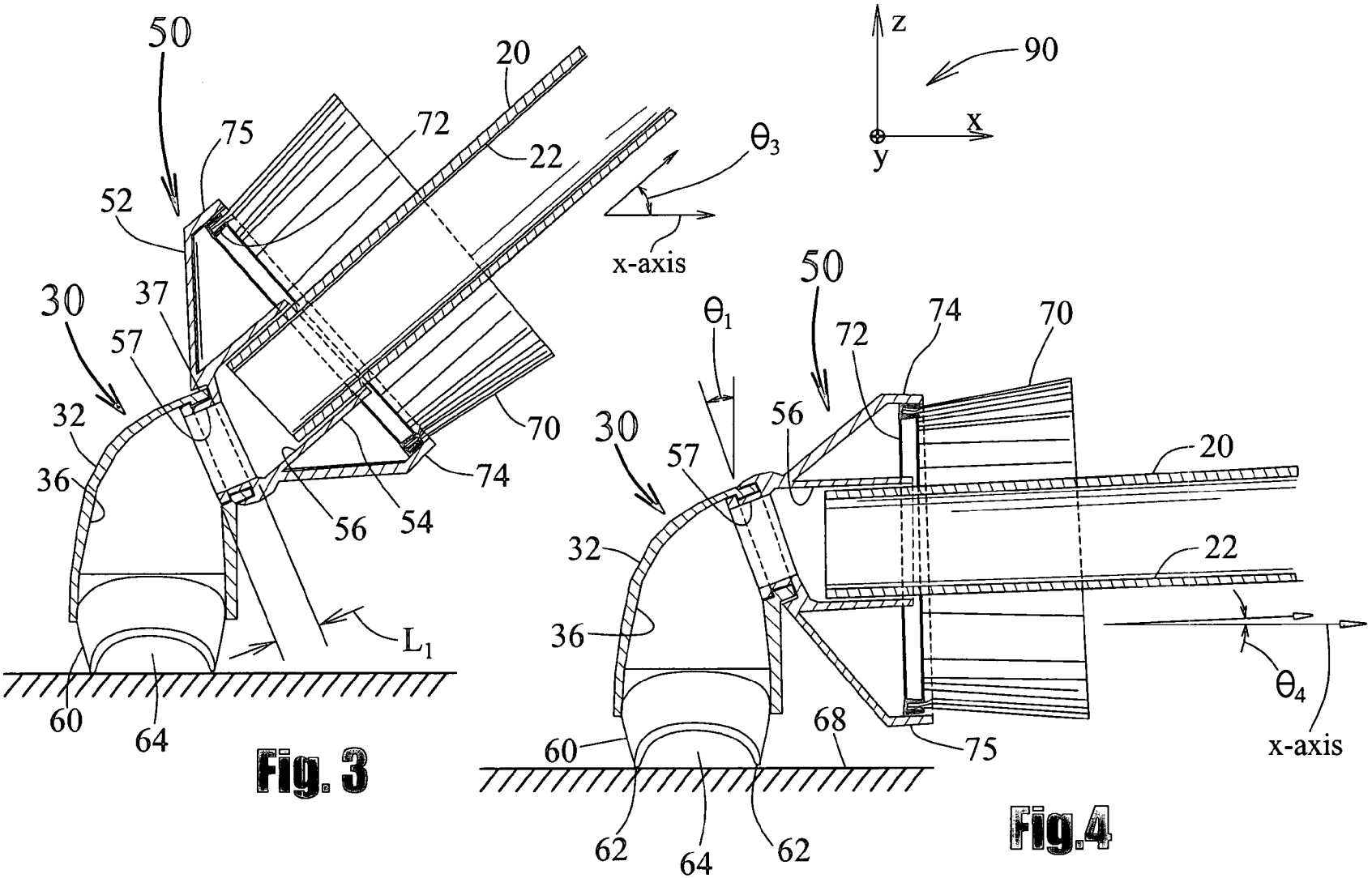

FIG. 3 Section view of Pivotal Nozzle Body in FIG. 1 (hose wand away from x-axis)

FIG. 4 Section view of Pivotal Nozzle Body in FIG. 1 (hose wand near x-axis)

Figure 5:
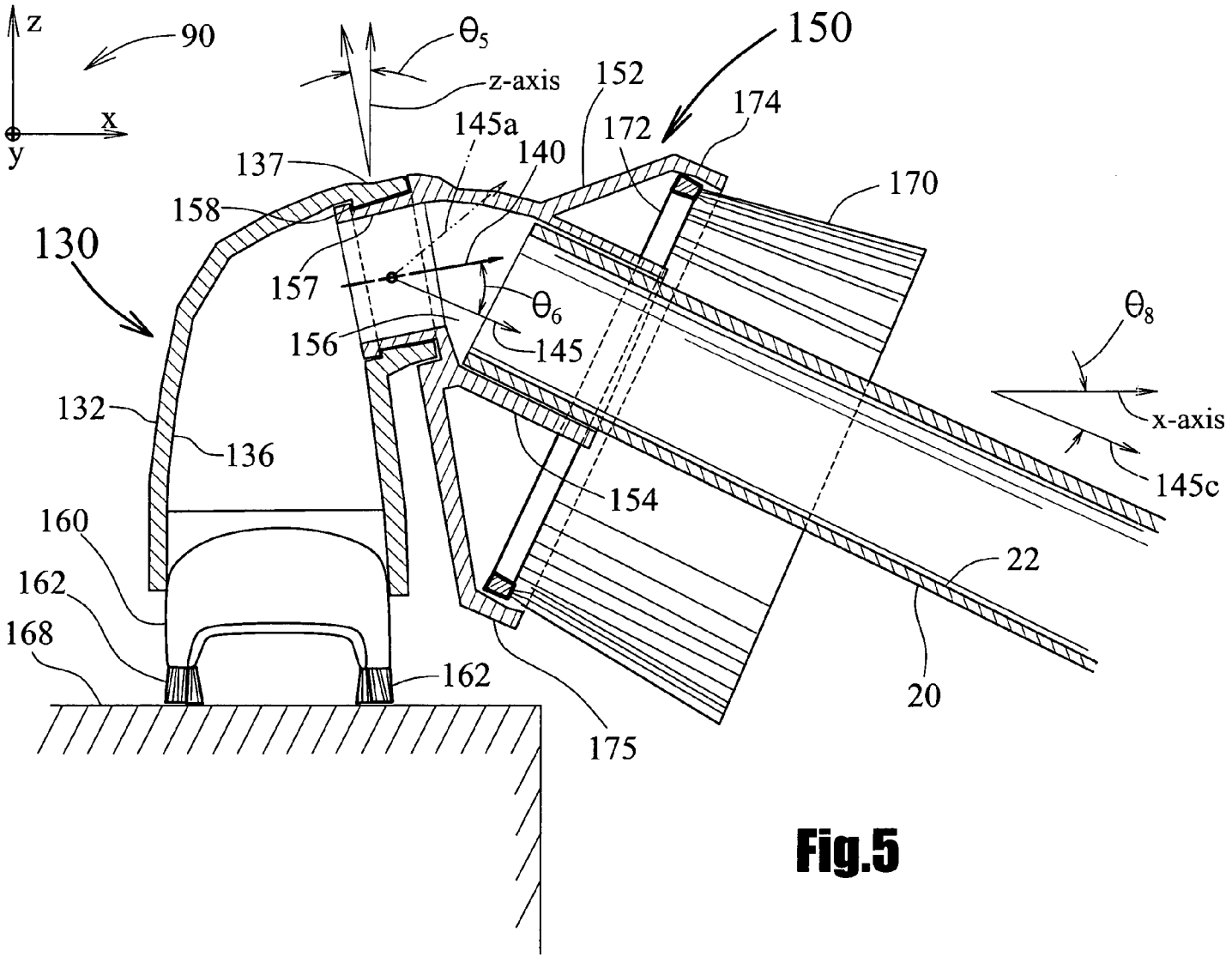

FIG. 5 Section view of an alternative Pivotal Nozzle Body (lower housing 130 and upper housing 150) with pivot axis angles $\theta_5$ and $\theta_6$ being different than $\theta_1$ and $\theta_2$.

Figures 6, 7:
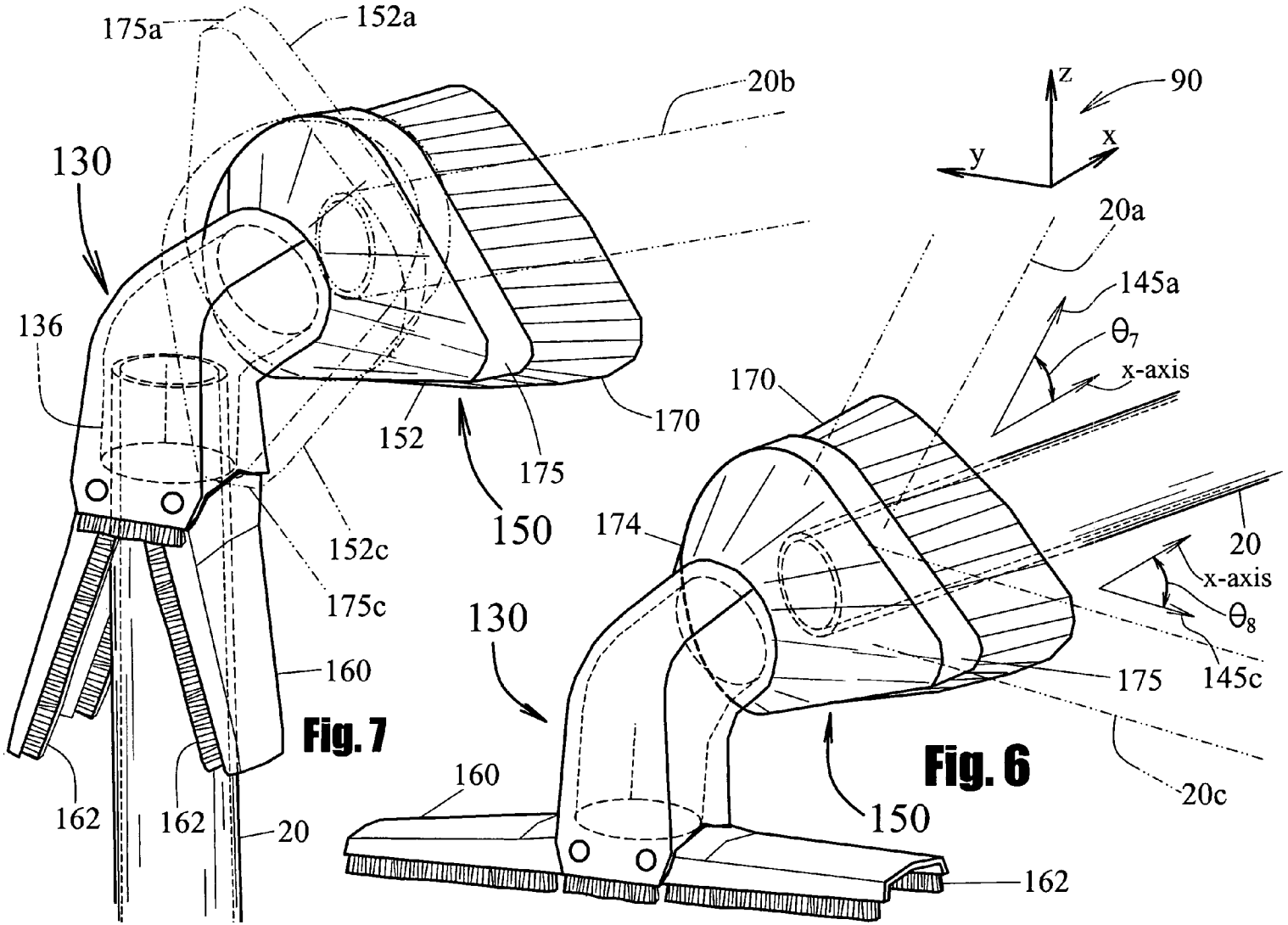

FIG. 6 Perspective view of pivot nozzle in FIG. 5 pivoted at approx. 90 degrees from the position shown in FIG. 5 with hose wand connected to brush end.

FIG. 7 Perspective view of pivot nozzle in FIG. 5 pivoted at approx. 90 degrees from the angle shown in FIG. 5 with hose wand connected to pivot arm end.

DETAILED DESCRIPTION OF THE INVENTION

The disclosed pivotal nozzle body can be manufactured using any of a number of durable materials. For example, organic polymers, such as, ABS, Polypropylene, etc. are its preferred construction materials, but can also be constructed of other materials, such as, stamped or machined metals or composites. The tolerances for the disclosed pivotal nozzle body is well within the accuracy range for injection molded plastic parts, with components designed to snap together during the manufacturing process.

FIGS. 1 through 4 show one example of a multi-function vacuum nozzle using a pivotal nozzle body comprising an upper housing 50 and a lower housing 30. Upper housing 50 comprises a brush shroud 52, a first tool end 55 on the brush shroud for connecting a dust brush 70, a hose wand port 54 with air channel 56 therethrough, and a first pivot end 57 with air channel 59 (formed by pivot rings 37 and 57) therethrough, for connecting to lower housing 30. Lower housing 30 comprises a lower body section 32 with air channel 36 therethrough, a second tool end 34 for connecting arms 60, and a second pivot end 37 for connecting to upper housing 50. Air channels 36 and 56 also act as friction fit hose wand port connectors. Within the pivotal nozzle body, air channels 36, 59 and 56 form a continuous air channel for communicating suction air from one hose wand port to the opposite tool end. This continuous air channel allows a suction hose wand 20, when inserted into air channel 56 (see FIGS. 1 through 6), to provide suction air to second tool end 34 and arms 60. This continuous air channel also allows suction hose wand 20, when inserted in air channel 36 (see FIG. 7), to provide suction air to first tool end 55 and dust brush 70.

Upper housing 50 defines an air passageway 56 which is designed to accept hose wand 20 as shown. Air channel 56 may be formed by a cylindrical tube 54 that is molded into upper housing 50. Also on upper housing 50 is a upper tool support (or shroud) 52 with a dust brush connector (first tool end) 55 for supporting a dust brush 70. For this design dust brush 70 has a metal U-channel support 72 which holds the bristles of the brush together. U-channel 72 fits snugly into outer lip of connector end (first tool end) 55 on brush shroud 52 to attach it to upper housing 50. Tool end 55 can be a circular shaped, a tear drop shaped, a triangular shaped or nearly any shape to hold a dust brush or other tool of that shape. Other types of cleaning tools can be attached on tool connector 55, if they have a matching connector style. Alternatively, tool connector end 55 can be modified to other connector styles if desired. In this way, the tool holder portion of housing 50 (shroud 52 and tool holder 55) can be designed to accept other vacuum cleaning tools with a different connector style(s).

Lower housing 30 can be adapted to connect a variety of different vacuum tools at second tool end 34. Arms 60 snap fit into two pairs of holes in connector 34 to provide a pivot axis in the x-axis direction to allow arms 60 to pivot between an in-line position (see FIG. 6) and a closed position (see FIG. 7 for almost closed arms). This type of arm connector style is only one example of the nearly unlimited design possibilities for connector 34. Air channel 36 within body section 32 and the arm connector (second tool end) 34 is designed so that vacuum hose 20 fits snugly into it (see FIG. 7 for example on similar nozzle), when the arms are slightly spread apart. In FIGS. 1 through 4, two arms 60 (other arm directly behind the one shown—view is looking at arm on end—see FIG. 7 for example on similar position for nozzle arms 160) are shown mounted on second tool end 34. Second tool end 34 can be designed to provide pivotal attachment for arms 60 so they may pivot between a crevice tool position and an upholstery tool position. In upholstery position (and floor tool FIGS. 1 through 6) the arms extend along the y-axis with edges 62 for making contact with a surface to be cleaned 68. In the crevice tool mode (see partial example in FIG. 7), arms 60 would rotate together so that U-channels 64 coming together to form an single elongated channel. Tool end 34 in FIGS. 1 through 4 comprise two flanges on each side of arms 60, which can be molded directly into lower housing 30. Lower housing 30 has a body section 32 with interior channel 36 which is designed to accept hose wand 20, and communicate suction air through channel 36 and the rest of the pivotal nozzle body.

Lower housing 30 is attached to upper housing 50 at a pivot joint near the middle of the pivotal nozzle body (housings 30 and 50). The pivot joint comprises a female ring shaped port 37 (second pivot end) with a locking lip 38 on lower housing 30, and a male ring shaped tube 57 (first pivot end) with a locking groove 58 on upper housing 50. A tube 57 has a groove 58 that interacts with groove 38 on ring 37 to hold housing 30 and 50 together. Ring 37 and tube 57 are designed to rotate about the pivotal nozzle body's pivot axis 40 and provide 360 degree pivotal action for the pivotal nozzle body (housings 30 and 50). The direction of pivot axis 40 may be oriented in a number of possible directions and does not need to lie in the x-z plane as it does in FIGS. 1 through 7 (discussed further in these specifications). In general, the pivot axis should be within 45 degrees of the x-axis, however for specific purposes a greater angles can be better (i.e. for vacuum tools where a side-to-side motion is used). For use with upholstery tools or floor tools, using 45 degrees or less from the x-axis provides a reasonably stable tool, but 30 degrees or less is better. Angles from the x-axis of more than 45 degrees starts to make a floor tool or an upholstery tool unstable, and they tend to flop around on the end of the hose wand during use. Note that the terminology "within 45 degrees of the x-axis" refers to set of directions the pivot axis may lie on within a cone centered along the x-axis. This means the direction of the pivot axis 40 may be angled above or below the horizontal, and to the left and right (a directional component along the y-axis).

In FIG. 3 we see that the pivot joint formed by ring 37 and tube 57, has a length $L_1$. This length $L_1$ is rather short for this type of pivot axis, however, if hard plastics are used, this type of pivot joint can work smoothly. Most often pivot joints of this nature have a length of about one inch or more (see FIG. 5 for example of a longer pivot joint). This helps keep the joint from binding against is own surfaces as additional forces try to twist it. Some friction is desirable for the pivot joint and may be provided by the surface contact between tube 57 of upper housing 50 and ring 37 of lower housing 30. While very little friction is needed when the nozzle is being used as a floor tool, friction is needed for other functions of the nozzle, such as, when the dust brush 70 is being used or the arms are used as a crevice tool. This friction may also be created by one or more snap lock positions where the upper and lower housings click into a high friction position. These locking positions may be provided by a notch on one housing and a matching tab on the other housing. The tab (or tabs) would snap into the notch (or notches) as the upper and lower housings are rotated with respect to each other. These notches and tabs are not shown in the figures to keep the drawing more readable, but may be placed on any of the contacting surfaces between housings 30 and 50 to create the snap lock positions. These snap lock positions are designed to automatically release by applying more rotational force to the pivot joint to cause the tabs to slide pass the notches. Sufficient locking friction is provided to allow normal use of the tools on the nozzle, but still easily released with additional force to change its orientation.

For purposes of clarity, the disclosed pivot nozzles have their lower housings (i.e. housing 30 in FIGS. 1–4 and housing 130 in FIGS. 5–7) oriented similarly with respect to a coordinate axis system 90 in all figures. Each drawing sheet includes an axis map 90, which shows the direction of the x, y and z-axis for discussion drawings on that sheet to provide a right-hand coordinate system. The arrows marked x, y, z on axis system 90 each denote the x-axis, y-axis and z-axis, respectfully. In FIGS. 1 through 5, the y-axis points directly into the page with the x-axis and z-axis in the plane of the paper. In FIGS. 6 and 7, both the x-axis and y-axis are angled into the page with the z-axis in the plane of the paper. This coordinate system, with respect to FIGS. 1 through 7, may be also used in the claims to define the pivot axis of the pivotal nozzle body (housings 30 and 50 in FIGS. 1–4 and housings 130 and 150 in FIGS. 5–7). The lower housings (housings 30 and 130) are oriented so that the cleaning edges 62 and brush strips 162 for the upholstery tool (see FIGS. 1–6) align with the x-y plane and the pivot axis for the arms is substantially aligned with the x-axis. This position also allows arms 60 and 160, to pivot downward to align in the negative z-axis direction for use as a crevice tool (see FIG. 7 for partial example). This defines the x-axis as pointing in the direction of the upper housing (i.e. upper housing 50 in FIGS. 1–4 and housing 150 in FIGS. 5–7) and parallel to the surfaces to be cleaned 68 and 168, respectfully.

Axis angles $\theta_1$ and $\theta_2$ are defined by the structure of nozzle housings 30 and 50, respectfully. Lower housing 30 defines angle $\theta_1$ as generally the minimum angle between the rotational axis of second pivot end 37 and the plane defined by cleaning edges 62 (x-y plane, measured from the positive x-axis in drawings). Angle $\theta_1$ can also be thought of as the angle between pivot axis 40 and the longitudinal axis of hose wand port 36 (negative z-axis) minus ninety degrees. Upper body housing 50 defines angle $\theta_2$ as the angle between the axis of first pivot end 57 and the longitudinal axis of hose wand port 54 (the angle between the pivot axis 40 and longitudinal axis 45 of hose wand port 54—see FIGS. 1 and 2). Notice that the longitudinal axis 45 of the hose wand port 54 is the same as the longitudinal axis of hose wand 20, which is inserted within air channel 56 of port 54. Rotation of housing 50 with respect to housing 30 provides a ring of orientations 44, which longitudinal axis 45 may be pivoted to. Ring 44 shows the many directions axis 45 can be directed to, with ring 44 extending into and out-of the page, except for directions 45 and 46. Only axis positions 45 and 46 in FIG. 1 lay within the plane of the page, the remaining directions all have a y-axis component to their direction. The nozzle's longitudinal axis 45 is near the x-axis in position 46, seen in FIG. 1, is shown oriented this way in FIGS. 2 and 4). When hose wand port 54 is in position 45, as seen in FIGS. 1 and 3, hose wand 20 is at a maximum angle $\theta_3$ with the surface to be cleaned 68 (x-y plane). At this maximum angle position (shown in FIGS. 1 and 3), maximum angle $\theta_3$ is equal to angle $\theta_1$ plus angle $\theta_2$. At hose wand port axis alternate position 46, as seen in FIG. 1 (see axis 45 in FIG. 2), upper housing 50 has been rotated around pivot axis 40 approximately 180 degrees from the position seen in FIG. 1. When hose wand port 54 is in position 45 in FIGS. 2 and 4, hose wand 20 is at an minimum angle $\theta_4$ with the surface to be cleaned (x-y plane). At this minimum angle position (shown in FIGS. 2 and 4), minimum angle $\theta_4$ is equal to angle $\theta_1$ minus angle $\theta_2$. Note that choosing different angles for $\theta_1$ and $\theta_2$ (see FIGS. 5 through 7) can result in a different final maximum angle $\theta_3$ and minimum angle $\theta_4$ for hose wand 20.

For orientations between the positions seen in FIGS. 1 and 2, the hose wand port 54 changes between these two values. Notice that hose wand 20 does not stay in the x-z plane during this transition except at the two positions shown. At all other positions the hose wand will have a component in the "y" direction (y-axis), that is, coming in or out of the paper in FIGS. 1 through 4 (see position ring 44 in FIG. 1). Many different ranges of angles for the the hose wand angle changes may be designed into the pivotal nozzle body by changing the values of $\theta_1$ and $\theta_2$ (see FIG. 5). Also, if the pivot axis 40 is given a y-axis component (that is, its axis no longer lies on the page in FIGS. 1 through 4), then more complicated changes in the direction of hose wand port 56 may be achieved. The variation is nearly endless, and can provide the specific angle changes desired for specific cleaning needs as the user pivots upper housing 50 with respect to lower housing 30.

In FIGS. 5 through 7, we see an alternative pivot nozzle with upper housing 150 and lower housing 130. This pivotal nozzle body (housings 130 and 150) can be designed for attachment of similar tools seen on pivot nozzle seen in FIGS. 1 through 4. Lower housing 130 comprises a angled tube shaped body section 132 with a air channel 136 passing through it. At the tool end of body 132 are attached a pair of arms 160 with brush strips 162 along its contact surface. On the pivot end of body section 132 is molded a pivot ring 137 which engages pivot tube 157 on housing 150. Ring 137 and tube 157 define a pivot joint with a pivot axis 140. As with pivot axis 40 in FIGS. 1 through 4, pivot axis 140 lays within the x-z plane, but can easily be designed to have a y-axis component if desired. Upper housing 150 comprises a pivot port defined by tube 157 at one end and a hose wand port 154 at the other end, with an air passageway 156 formed between tube 157 and port 154. A brush skirt 152 is included here as a brush cleaning tool holder with a forward end 175 and a rearward end 174. Dust brush 170 with molded plastic support 172 is attached to upper housing 150 by brush skirt 152. Port 154 is designed for removable attachment of vacuum hose 20 to provide suction air to cleaning arms 160. Air passageway port 136 is designed for removable attachment of vacuum hose 20 to provide suction air to cleaning brush 170. While the hose wand needs to be able to be removably attachable to both ends of the disclosed pivotal nozzle body, the tools can be molded into the nozzle housings permanently. The pivotal nozzle body, however, can be designed to allow removable attachment of different vacuum tools on one or both ends of the pivotal nozzle body. Removal can be to replace worn cleaning tools (i.e. dust brush bristles, bristle strips on arms, etc.) or to provide additional functions with different attachments. For example, for the pivot nozzle in FIGS. 5 through 7, dust brush 170 can be snapped out of tool skirt 152 and another tool can be snapped into place (i.e. wider dust brush, special crevice tool, special floor tool, etc.). Similarly, arms 160 can be designed to easily be removed so that other arms or other tools can be snapped into place.

In FIGS. 5 through 7, axis angles $\theta_5$ and $\theta_6$ are defined (like axis angles $\theta_1$ and $\theta_2$) by the structure of nozzle housings 130 and 150, respectfully. Lower housing 130 defines angle $\theta_5$ as generally the minimum angle between the rotational axis of second pivot end 137 and the plane defined by cleaning brush strips 162 (x-y plane, measured from the positive x-axis in drawings). Angle $\theta_5$ can also be thought of as the angle between pivot axis 140 and the longitudinal axis of hose wand port 136 (negative z-axis) minus ninety degrees. Upper body housing 150 defines angle $\theta_6$ as the angle between the axis of first pivot end 157 and the longitudinal axis 145 of hose wand port 154 (the angle between the pivot axis 140 and longitudinal axis 145 of hose wand port 54—see FIG. 5).

In FIG. 5, upper housing 150 can be rotated with respect to lower housing 130 to provide its minimum angle between the two housings (dust brush tip 175 pointing in the direction of surface 168). This minimum orientation of the pivot nozzle body is shown by phantom position 20*c* of hose wand 20 in FIG. 6, and phantom position 152*c* of tool skirt 152 in FIG. 7. The angle The $\theta_5$ angle is ten degrees, such that pivot axis 140 is ten degrees above the x-y plane, which defines the orientation of pivot axis 140 on lower housing 130, and means pivot axis 140 is nearly parallel with the surface being cleaned 168. The $\theta_6$ angle is thirty-five degrees, which defines the angle difference between pivot axis 140 of pivot port 157 and longitudinal axis 145 of hose wand port 154 (same longitudinal axis as hose wand 20). The result is a pivot nozzle body with a range of motion for hose wand 20 between positive forty-five degrees above the x-y plane (see phantom lines 20*a* and 152*a*, in FIGS. 6 and 7 respectfully), and twenty-five degrees below the x-y plane (see phantom lines 20*c* and 152*c*, in FIGS. 6 and 7, respectfully). The pivot joint composed of ring 137 and tube 157 hold housings 130 and 150 together by the interaction of ring-shaped ridge 158 on tube 157 with the edge of pivot ring 137. Both ring 137 and tube 157 are circular in cross section so that ring 137 can easily rotate around tube 157. Additional bearing rings can be placed between the contacting surfaces of ring 137 and tube 157, to control friction, wear, and/or other factors, as is common in present day vacuum nozzles.

In FIGS. 6 and 7, we see perspective views of the pivotal nozzle body in FIG. 5, with the upper housing 150 pivoted about ninety degrees from its orientation shown in FIG. 5. Both show upper housing 150 rotated approximately half way between its maximum angle $\theta_7$ and its minimum angle $\theta_8$. In FIG. 6, upper housing 150 is shown at 90 degrees from its maximum angle position (midway between maximum and minimum angles). Notice that at 90 degrees rotation hose wand 20 is slightly above being parallel to the x-y plane (approximately positive 10 degrees for the numbers chosen, $\theta_5$=10 degrees, $\theta_6$=35 degrees). If housing 150 is rotated slightly further as shown in FIG. 7, hose wand 20 can be parallel to the x-y plane as shown by shadow position 20*b* in FIG. 7. Further rotation of hose wand 20 moves housing 150 to minimum position 152*c* and 175*c* (see FIGS. 5 and 7), and hose wand 20 at position 20*c* (see FIGS. 5 and 6). Alternative orientations for upper housing 150 are shown by shadow lines. The orientation at maximum angle value $\theta_7$ for the pivot nozzle body in FIGS. 5 through 7, is shown by hose wand 20 in position 20*a* with longitudinal axis 145*a* (in FIG. 6), and upper housing position 152*a* of tool skirt 152 (in FIG. 7). The orientation at minimum angle value $\theta_8$ for the pivot nozzle in FIGS. 5 through 7, is shown by hose wand 20 in position 20*c* with longitudinal axis 145*c* (in FIG. 6), and upper housing position 152*c* of tool skirt 152 (in FIG. 7). The thirty-five degree angle in housing 150 ($\theta_6$=35 degrees) means that, in the positions shown in FIGS. 6 and 7, the hose wand's longitudinal axis is pointing about thirty-five degrees away from the x-y plane. In FIG. 6, this causes the arm marked 160 to angle forward with respect to hose wand 20. This can be used as an advantage, because the end of the forward leaning arm 160 can be used to suck up dirt and material along an edge running perpendicular to hose wand 20 (using the open end of arm 160 against a surface to function like a crevice tool. The nozzle in FIG. 6 can be used as a full crevice tool by simply pivoting both arms 160 together so that their brush strips 162 touch (see FIG. 7 with arms partially closed). The nozzle in FIG. 7 can be used as a crevice tool by simply inserting hose wand 20 into upper housing 150 a position 20*b* and closing arms 160 so that brush strips 162 seal against each other. Different orientations of the pivotal nozzle body can be used for the crevice tool mode to reach differently angled surfaces, with pivot joint friction maintaining the desired orientation for cleaning.

Some of the differences between housings 130 and 150, and housings 30 and 50, comprises changes to the pivot joint and the axis angles $\theta_1$ and $\theta_2$. The pivot joint in FIGS. 5 through 7, comprises ring shaped lip 137 (first pivot end) on the lower housing 130, and ring shaped tube 157 (second pivot end) on upper housing 150, which are connected so that upper housing 150 can swivel with respect to lower housing 130. Ring 137 and tube 157 in FIGS. 5 through 7 are longer than ring 37 and tube 57 in FIGS. 1 through 4. This can give the pivotal nozzle body greater stability from binding when forces needed to swivel the pivot joint are applied. The pivot joint is also at a different angle than in the design in FIGS. 1 through 4. The values of angles $\theta_5$ and $\theta_6$ have been modified compared to axis angles $\theta_1$ and $\theta_2$, respectfully, to allow hose wand 20 to pivot below the x-y plane in its minimum angle position (angle $\theta_8$ negative). For lower housing 30 in FIGS. 1 through 4, $\theta_1$ on housing 30 was approximately 25 degrees, and $\theta_2$ on housing 50 was approximately 20 degrees. In FIGS. 5 through 7, lower housing 130 has a $\theta_5$ of approximately 10 degrees, and upper housing 150 has a $\theta_6$ of approximately 35 degrees. This results in both pivot nozzle bodies to have the same maximum angle ($\theta_3$ equal to $\theta_7$) of approximately 45 degrees, but different minimum angles $\theta_4$ and $\theta_8$. The pivotal nozzle body in FIGS. 1 through 4 has a $\theta_4$ of approximately positive 5 degrees, while the pivotal nozzle body in FIGS. 5 through 7, has a $\theta_8$ of approximately negative 25 degrees (a thirty degree difference). This negative angle can be used to allow cleaning of high surfaces, such as, the tops of cabinets and book shelves. This angle arrangement also allows the user to lower the hose wand parallel to the floor without having to rotate hose wand 20 around its longitudinal axis a full 180 degrees. Instead, the hose wand can be brought parallel to the floor (x-y plane), in upholstery mode by rotating hose wand 20 about 100 degrees from its maximum angle position (phantom positions 20*a*, 152*a* and 175*a*).

Operational Description—FIGS. 1 *Through* 4

During use, hose wand 20 is inserted in port 56 or port 36 to provide suction air to the pivotal nozzle body disclosed in FIGS. 1 through 4. Both channel port 56 and air channel port 36 provide a snug fit for hose wand 20 so that friction keeps the hose wand attached. Other methods can be used to hold a hose wand on the nozzle, including positive locking systems, such as, twist and lock connectors (bolt action like engagement), spring loaded buttons (button on hose or nozzle engaging a hole in the nozzle or hose respectfully), etc.

With hose wand 20 inserted into port 56 (see FIGS. 1 through 4), suction air is provided to cleaning arms 60 for cleaning. For floor cleaning, cleaning edges 62 are placed flat against a surface to be cleaned 68 (floor, upholstery, etc.—see FIGS. 4 and 5). Air is pulled in through channel 64 formed by arms 60 being in contact with surface 68, through port 36, through pivot channel 59, through port 56 and finally into hose wand channel 22, which leads to a vacuum cleaner. Arms 60 on second tool end 34 can be pivoted to provide added functions, such as, allowing the folding together of the arms to create a crevice tool or separated slightly to create a gap for cleaning blinds, or the arms may also be pivoted apart to form a floor tool or an upholstery tool, or other angles for the arms. Other specialty tools may be used in place of arms 60. Also, while arms 60 are designed to be removable from lower housing 30, they are not designed to be easily removable by the user. In an alternative design, tool end 34 may be designed to allow the user to easily add and remove different tools from end 34 to provide multiple function. Tool end 34 can easily be modified in shape and size to meet the needed functional needs for the vacuum tools that will be attached to it. Similarly, tool end 55 may also be designed to allow multiple user attachable and removable tools. Also notice that the tools do not have to be centered around hose wand ports 36 and/or 56. Also notice that the end of port 36 and/or port 56 may be formed into a cleaning tool by itself.

With hose wand 20 inserted into port 36, the dust brush 70 may be used for cleaning, with suction air from hose wand 20, pulling air from around dust brush 70 through air channel 56, through pivot joint air channel 59, through air channel 36, and finally into hose wand 20. Upper housing 50 and dust brush 70 may be rotated about pivot joint axis 40 to provide different cleaning angles for the dust brush as desired.

When the user operates the vacuum tool as a floor tool or an upholstery tool (as seen in FIGS. 1 through 4), hose wand 20 is inserted into port 56. Hose wand 20 fits tightly into port 56 so that rotation of hose wand 20 by the user put a rotational torque on upper housing 50. With arms 60 extending along the y-axis (in-and-out of the page in FIGS. 1 through 4), the arms resist this torque that is transmitted through the pivot joint and allows the user to rotate upper housing 50 with respect to lower housing 30. Thus, the user may be cleaning a surface 68 with the pivotal nozzle, with contact edges 62 against the surface (see FIGS. 1 and 3), while the user holds onto the far end of the hose wand (not seen off the page). To clean under low furniture or other low objects, the user simply twists the upper part of hose wand 20 in their hand, which turns upper housing 50 with respect to lower housing 30. Friction between the contact surfaces at the pivot joint (contact between ring 37 and tube 57) transmits this rotational force to lower housing 30 which resists rotating about hose wand 20 because of the extended arms 60, which push against surface 68. The separated nature of arms 60 resist allowing lower housing 30 also pivoting. Thus, while front end 75 of brush connector 55 begins to move away from its upward facing orientation and rotate toward the floor while rear end 74 of brush connector 55 begins to move way from its downward facing position, cleaning edges 62 remain substantially in contact with the surface being cleaned 68. As upper housing 50 rotates with respect to housing 30, hose wand 20 must change its angle with respect to cleaning arms 60 to keep cleaning edges 62 in contact with surface 68. When housing 50 has been rotated about ninety degrees from its position in FIG. 1 hose wand 20 is angled about twenty-five degrees above the floor. At the same time, because $\theta_2$=20 degrees, this rotated position places hose wand 20 at an angle of about twenty degrees toward the y-axis (into or out-of the page—see FIG. 6 for example).

As hose wand 20 is rotated further toward the position seen in FIG. 2, the hose wand can be moved closer and closer to being parallel with the floor (see FIGS. 2 and 4) while keeping cleaning surfaces 62 in contact with surface to be cleaned 68. Front end 75 of brush connector 55 is now pointing toward surface 68 and brush connector rear end 74 is pointing upward away from surface 68. In this position, with hose wand 20 nearly level with the floor (approximately five degrees above the floor), the user can now get the pivotal vacuum nozzle under the low furniture for cleaning. Similarly, when the user is done cleaning under the low furniture, they can twist the hose wand back to its original position (see FIGS. 1 and 3) to restore the hose wand to its upright cleaning position.

The operation of the pivotal nozzle body in FIG. 5 is essentially the same as in FIGS. 1 through 4. Only the angle range of the hose wand is changed by the selection of $\theta_5$ and $\theta_6$. The maximum upright angle $\theta_7$ (obtuse angle between hose wand ports 154 and 136 is greater than ninety degrees) is the same as maximum upright angle $\theta_3$ in FIGS. 1 through 4, but the minimum angle $\theta_8$ (acute angle between hose wand ports 154 and 136 is less than ninety degrees) can be much lower than the minimum angle $\theta_4$ in FIGS. 1 through 4. Because angle $\theta_8$ is a negative angle (hose wand axis extending below x-y plane), the hose wand does not need to be twisted 180 degrees to be parallel to the floor. In fact, for the choices of $\theta_5$=10 degrees and $\theta_6$=35 degrees, hose 20 would only need to be twisted about 100 degrees from its 152*a* position (see FIG. 7) to reach parallel to the floor (x-y plane). Further rotation moves hose wand 20 below cleaning surface 68 (x-y plane) as seen in FIG. 5 to form an acute angle between longitudinal axis 145 of hose wand port 154 and the longitudinal axis of hose wand port 136 (negative z-axis).

In FIG. 7, we see the pivot nozzle being used as a dust brush with hose wand 20 inserted into air passageway (hose wand port) 136. Arms 160 are angles approximately as shown to allow easy insertion of hose wand 20. The angle between tool ends is about 90 degrees (angle between hose wand 20 shown in FIG. 7 and phantom hose wand position 20*b*. This allows the cleaning portion of dust brush 70 to be parallel to the hose wand axis. Further angling of upper housing 150 to position 152*c* results in an acute angle between the hose wand ports that allows cleaning high surfaces as shown in FIG. 5 with either the upholstery tool as shown or the dust brush (see FIG. 7).

Stability During Operation

The issue of stability of the nozzle during use occurs because of the ability of the disclosed pivot nozzle to pivot around a pivot axis. If the angle of the pivot axis is not chosen correctly or if the pivot joint has too little friction for stable use, the tool end of the nozzle can simply flop around on the end of the nozzle uncontrollably. For different uses, and functions, different parameters are needed. For example, for a floor or upholstery tool the pivot axis works best if it is closer than 45 degrees from the x-axis as defined in the drawings. While larger angles work fine for other cleaning purposes (i.e. dust brush use) placing the pivot axis near the y-axis and or the z-axis makes the nozzle unstable for floor and upholstery cleaning (see FIG. 6 for example of floor and upholstery mode). This instability results from two factors. When the pivot axis is too close to the z-axis, any differential x-axis force on the ends of the arms can tend to spin the lower housing about the pivot axis. Similarly, if the pivot axis is too close to the y-axis, x-axis force on either arm can tend to rotate the lower housing about the pivot axis. It turns out that for floor and upholstery cleaning, the best stability and range of angle orientations is achieved with a pivot axis no more than 30 degrees from the x-axis. Unfortunately, this range is not necessarily very good for some other tools, namely the dust brush and arms in crevice mode, which experience y-axis forces during normal use. This y-axis force tends to rotate the tool around the pivot axis (see pivot axises 40 and 140). This tool rotation problem, however, is easily solved by simply providing some internal friction to the pivot joint, so that during normal dusting or crevice tool use, the y-axis forces are not great enough to overcome the friction within the pivot joint. This friction, however, cannot be so great that it interferes with the use of the tool in floor cleaning mode. The nozzle body should be easily pivotable by the user, when twisting on the hose wand attached to it. Luckily, the twisting force a user can place on the hose wand, and the leverage the extended arms can provide, is considerably greater than the friction needed for stable dusting or crevice tool use. Thus, the user can easily rotate the hose wand about the pivot axis and lower the hose wand to the floor to get under furniture and the like even, when sufficient friction is present to allow normal dusting and crevice tool operation. The pivot joint friction may come in a number of forms, from a continuous friction force between the upper and lower housing, a notch and tab arrangement to provide specific orientations where greater friction force is located, etc. or a combination of different friction methods.

Ramifications, and Scope

The disclosed design for a multi-function pivotal nozzle body with a built in pivot joint allows for a very compact vacuum nozzle to be designed that provides many functions, including a floor tool that can pivot with respect to an attached hose wand. In floor mode this pivot joint allows the nozzle's cleaning surfaces to remain flush against the floor, while the hose wand can be lowered to the floor to get under low furniture. The pivot joint is also useful for cleaning high surfaces (see FIGS. 5 through 7) because it can allow the tool ends to be pivoted to an acute angle with respect to the hose wand. This allows the tool to make contact with a high surface while the hose wand angles downward from the nozzle, thus eliminating the need for the user to get on a chair or ladder to reach the surface.

Although the above description of the invention contains many specifications, these should not be viewed as limiting the scope of the invention. Instead, the above description should be considered illustrations of some of the presently preferred embodiments of this invention. For example, many angle combinations are possible, including ones where the pivot axis does not align with the x-z plane as it does in FIGS. 1 through 7.

If we consider $\theta_1$, and $\theta_2$ variables then the pivotal nozzle body in FIGS. 1 through 4 can be modified by simply changing the values of $\theta_1$ and $\theta_2$ For example, pivot axis that aligns with the x-axis would have a $\theta_1$ equal to zero degrees on housing 30, while housing 50 may have a $\theta_2$ equal to forty-five degrees so that hose wand 20 can have the same maximum angle $\theta_3$ equal to forty-five degrees. Notice though that with this angles ($\theta_1$=0 degrees, and $\theta_2$=45 degrees) the hose wand can be rotated to negative forty-five degree angle below the x-y plane. Notice that angle $\theta_1$ itself can be negative (pivot axis pointing below the x-y plane), which would provide extreme angle changes when hose wand 20 is rotated. However, a negative $\theta_1$ would create a somewhat "S" shaped suction passageway through the pivot nozzle, which could restrict air flow. The combinations are nearly endless. Also, many ways exist to construct a pivot joint between the upper and lower housings. Many suction conduit pivot or swivel joints exist in prior art and most can be used in this application. Thus, the pivot joints shown are certainly not the extent of possible and known ways to construct a pivot joints for the disclosed pivotal nozzle body. The addition of other bearing rings or structures in the pivot joint are commonly used in the vacuum industry to control deformation of the softer nozzle housing materials, and/or to control friction within the joint. Finally, the basic pivotal nozzle body can be used as a general purpose pivot adaptor for connecting different sized tools and different sized hose wands on each end of the pivot nozzle body. The interior/exterior hose wand port design shown in prior art U.S. Pat. No. 6,581,974 can also be used with this pivot nozzle body to provide cross platform functionality.

Thus, the scope of this invention should not be limited to the above examples but should be determined from the following claims.

I claim:

1. A pivotal nozzle body, comprising:

a) a upper housing comprising a first tool end and a first pivot end;

b) a lower housing comprising a second tool end and a second pivot end;

c) a pivot means connecting said first pivot end to said second pivot end for pivotally connecting said upper housing to said lower housing;

d) wherein said upper housing, said pivot means, and said lower housing define a continuous suction passageway therethrough between said first tool end and said second tool end;

e) wherein said first tool end comprises a first hose wand port for removable attachment of a vacuum hose wand and a first mounting means for connecting a first vacuum cleaner tool to said first tool end, wherein the vacuum hose wand and the first vacuum cleaner tool may be connected to said first tool end at the same time;

f) wherein said second tool end comprises a second hose wand port for removable attachment of the vacuum hose wand and a second mounting means for connecting a second vacuum cleaner tool to said second tool end, wherein the vacuum hose wand and the second vacuum cleaner tool may be connected to said second tool end at the same time, and g) wherein said pivot means is oriented with respect to said upper housing and said lower housing for providing useful operation of both the first vacuum cleaner tool when the vacuum hose wand is connected to said second hose wand port and the second vacuum cleaner tool when the vacuum hose wand is connected to said first hose wand port.

2. The pivotal nozzle body in claim 1, further including;

one or more slip ring bearings between said first and second pivot end.

3. The pivotal nozzle body in claim 1, wherein;

said first tool end is adapted for attachment of a pair of pivotal cleaning arms.

4. The pivotal nozzle body in claim 3, wherein;

said pair of pivotal cleaning arms are movable to an opposed in-line position defined longitudinally along a y-axis in a right-handed Cartesian coordinate system and flush against an x-y plane, wherein said pivot means defines a pivot axis that is oriented at an angle less than forty-five degrees from the x-axis.

5. The pivotal nozzle body in claim 4, wherein;

said a pivot axis is less than thirty degrees from the x-axis.

6. The pivotal nozzle body in claim 4, wherein;

said a pivot axis is less than twenty degrees from the x-axis.

7. The pivotal nozzle body in claim 1, wherein;

said first and/or second vacuum cleaner tools are removably mounted to said first and/or second tool ends, respectfully.

8. The pivotal nozzle body in claim 1, wherein;

said first and/or second vacuum cleaner tools are permanently attached to said first and/or second tool ends, respectfully.

9. The pivotal nozzle body in claim 1, wherein;

said first tool end is adapted for mounting a dust brush.

10. The pivotal nozzle body in claim 1, wherein;

said upper housing and said lower housings are designed with appropriate angles between their respective tool end and pivot end, wherein the angle between the longitudinal axis of said first and second hose wand ports can be pivoted to both acute and obtuse angles.

11. The pivotal nozzle body in claim 1, wherein;

said first and/or second vacuum cleaner tools are removably mounted to said first and/or second tool ends, respectfully.

12. The pivotal nozzle body in claim 1, wherein;

said first and/or second vacuum cleaner tools are permanently attached to said first and/or second tool ends, respectfully.

13. The pivotal nozzle body in claim 1, wherein;

said pivot means defines a friction means for providing rotational friction to resist rotation of said upper housing with respect to said lower housing, wherein said friction means provides sufficient friction to allow said second vacuum cleaner tool to perform all its intended functions without significant undesired rotation of the pivot means.

14. A pivotal nozzle body, comprising:

a) a upper housing comprising a first tool end and a first pivot end;

b) a lower housing comprising a second tool end and a second pivot end;

c) a pivot means connecting said first pivot end to said second pivot end for pivotally connecting said upper housing to said lower housing;

d) wherein said upper housing, said pivot means, and said lower housing define a continuous suction passageway therethrough between said first tool end and said second tool end;

e) wherein said first tool end comprises a first vacuum cleaner tool and a first hose wand port for removable attachment of a vacuum hose wand, wherein the vacuum hose wand is connected to a second hose wand port during use of said first vacuum cleaner tool;

f) wherein said second tool end comprises a second vacuum cleaner tool and said second hose wand port for removable attachment of the vacuum hose wand, wherein the vacuum hose wand is connected to said first hose wand port during use of the first vacuum cleaner tool, and g) wherein said pivot means is designed for useful operation of said first vacuum cleaner tool when the vacuum hose wand is connected to said second hose wand port, and wherein said pivot means is designed for useful operation of said second vacuum cleaner tool when the vacuum hose wand is connected to said first hose wand port.

15. The pivotal nozzle body in claim 14, further including;

one or more slip ring bearings between said first and second pivot end.

16. The pivotal nozzle body in claim 14, wherein;

said first tool end is adapted for attachment of a pair of pivotal cleaning arms.

17. The pivotal nozzle body in claim 14, wherein;

said pivot means defines a pivot joint with a rotational axis oriented with respect to said first and second hose wand ports to allow effective operation of said first and second vacuum cleaner tools.

18. The pivotal nozzle body in claim 14, wherein;

said pivot means defines a friction means that resists rotation of said first pivot end with respect to said second pivot end, wherein said first and second vacuum cleaner tools can be used without significant undesired pivoting of said first and second pivot end with respect to each other.

19. The pivotal nozzle body in claim 14, wherein;

said first and/or second vacuum cleaner tools are removably mounted to said first and/or second tool ends, respectfully.

20. The pivotal nozzle body in claim 14, wherein;

said first and/or second vacuum cleaner tools are permanently attached to said first and/or second tool ends, respectfully.

* * * * *